United States Patent [19]

Pecoraro et al.

[11] Patent Number: 4,551,229

[45] Date of Patent: Nov. 5, 1985

[54] CRACKING OF HEAVY HYDROCARBONS WITH IMPROVED YIELDS OF VALUABLE LIQUID PRODUCTS

[75] Inventors: Theresa A. Pecoraro, Danville; Russell R. Krug, San Rafael; Joanne Deady, Rodeo, all of Calif.

[73] Assignee: Chevron Research Company, San Francisco, Calif.

[21] Appl. No.: 590,600

[22] Filed: Mar. 19, 1984

[51] Int. Cl.[4] ..... C10G 51/02; C10B 55/02

[52] U.S. Cl. ..... 208/76; 208/55; 208/74; 208/77; 208/164; 208/88; 208/91

[58] Field of Search ..... 208/55, 76, 77, 74, 208/164, 91

[56] References Cited

U.S. PATENT DOCUMENTS 3,684,689 8/1972 Patton et al. ..... 208/55

4,436,613 3/1984 Sayle et al. ..... 208/74

*Primary Examiner*—D. E. Gantz

*Assistant Examiner*—Chung K. Pak

*Attorney, Agent, or Firm*—S. R. Lapaglia; W. K. Turner; E. A. Schaal

[57] ABSTRACT

Hydrocarbon feedstocks, especially those high in Ramsbottom carbon, are vaporized by contact with a relatively inactive coked cracking catalyst, separating the resulting intermediate into a high and low boiling fraction, and cracking the high boiling fraction in a fluid catalytic cracker containing active cracking catalyst.

25 Claims, 4 Drawing Figures

CRACKING OF HEAVY HYDROCARBONS WITH IMPROVED YIELDS OF VALUABLE LIQUID PRODUCTS

BACKGROUND OF THE INVENTION

Fluid catalytic cracking (FCC) is one of the most important processes both in the United States and elsewhere for cracking petroleum feedstocks. In the FCC, a particulate catalyst is subjected to a continuous cyclic cracking reaction and catalyst regeneration procedure. In the reactor, the fluidized catalyst is contacted with a hydrocarbon feed usually at an average reactor temperature between about 800° F. and 1100° F. The reactions that occur in the reactor result in the deposition of a carbonaceous residue or coke on the catalyst particles. The cracked, or processed, hydrocarbon stream is separated from the coked catalyst and withdrawn from the cracking zone. The coked catalyst is stripped of volatiles in a steam stripping zone and passed to a catalyst regeneration zone. In the catalyst regeneration zone, the coked catalyst is contacted with a gas containing molecular oxygen to burn off a desired portion of the coke from the catalyst and simultaneously to heat the catalyst to a high temperature before the regenerated catalyst is recycled to the cracking zone.

In the typical FCC process, the particulate cracking catalyst is composed principally of silica and alumina. It may be an amorphous mixture of silica and alumina, but more likely, the catalyst will contain a crystalline aluminosilicate zeolite in an amorphous silica-alumina matrix. Conventional zeolitic cracking catalysts often include an X-type zeolite or a Y-type zeolite. The ability of these catalysts to perform their function is reduced by the presence of coke which is deposited on the particls during the cracking step. Although the coke may be removed during regeneration, excessive amounts will lead to deactivation of the catalyst resulting in lower activity and poor selectively to the desired products. Thus, most modern cracking catalysts are limited to cracking hydrocarbon charges having low coke forming tendency.

With the increasing interest in upgrading residual stocks and heavy crudes, it has become desirable to find ways for pretreating the feedstocks to lower the metals and Ramsbottom carbon levels in the feed before the cracking step. Metal contaminants such as iron, nickel and vanadium may act as poisons to the cracking catalysts and cause formation of excessive amounts of coke and gas. Ramsbottom carbon leads to the formation of coke on the catalyst particles and reduces catalyst activity. In one method of pretreatment, the feedstock is contacted with relatively inert fluidizable solid particles at a high temperature and for a brief residence time. In so doing, Ramsbottom carbon and metals content of the feedstock are lowered to the point where the pretreated feedstock may be fed to a conventional FCC unit. See U.S. Pat. No. 4,243,514.

In general, the coke forming tendency or coke precursor content of an oil can be ascertained by determining the weight percent of carbon remaining after a sample of that oil has been pyrolyzed. The industry accepts this value as a measure of the extent to which a given oil tends to form coke when employed as feedstock in a catalytic cracker. Two established tests are recognized, the Conradson carbon and the Ramsbottom carbon tests. The latter standard is described in ASTM Test No. D-524-76 and will be used in the following discussion.

In a common refinery situation, the feed to a fluid catalytic cracker will contain some material boiling in the range of desirable products. For example, the feed may contain material boiling in the range of diesel and jet fuel stocks. When contacted with active, regenerated catalyst in the FCC riser, this material undergoes a significant amount of dehydrogenation which reduces its value as diesel or jet fuel. Some of the material is also cracked to less desirable light gases.

BRIEF DESCRIPTION OF THE INVENTION

The present invention is directed to a process for catalytically cracking a hydrocarbon charge which comprises: (a) contacting the hydrocarbon charge in a coked catalyst zone at a temperature of at least 800° F. with a coked cracking catalyst having significantly reduced cracking activity, whereby at least a portion of the hydrocarbon charge is vaporized; (b) separating the hydrocarbon vapors into at least a high boiling fraction and a low boiling fraction; (c) reducing the amount of coke on the coked catalyst of step (a) in a regeneration zone by contacting the coked catalyst with molecular oxygen for a sufficient residence time and at a suitable temperature to regenerate the cracking catalyst; (d) cracking the high boiling fraction from step (b) in the absence of added free hydrogen in a cracking zone by contacting said high boiling fraction with the regenerated cracking catalyst, whereby a hydrocarbon product having a lower average molecular weight than the high boiling fraction is produced and coke is deposited on the cracking catalyst to significantly lower its cracking activity; and (e) introducing the coked cracking catalyst of step (d) into the coked catalyst zone for the purpose of contacting additional hydrocarbon charge.

The process described herein incorporates an initial separation of the hydrocarbons recovered from the coked catalyst zone (which may also be referred to as the decarbonization zone) into at least a high boiling and a low boiling fraction. This allows only the higher boiling components to be fed to the cracking step thus minimizing the possibility of overcracking the lower boiling components of the feed. In this manner, less gas and more useful liquid products are produced. This separation is especially useful in optimizing the production of either middle distillates such as diesel fuel and jet fuel or light distillates such as gasoline.

The catalyst employed in cracking the heavy fraction of the hydrocarbon intermediate in the cracking zone (also referred to as the active catalyst zone) also serves as the contact solid for the removal of Ramsbottom carbon from feeds of high coke forming tendency in a decarbonization step. The coked catalyst, recovered from the cracking reactor, is cycled to the decarbonization zone to serve as the coked cracking catalyst having significantly reduced cracking activity. In the decarbonization zone, additional coke is deposited on the catalyst. From the decarbonization zone, the catalyst is sent to a regenerator before being recycled to the cracking zone. The cracking catalyst thus serves two functions in the process, i.e., as an active cracking catalyst for the high boiling intermediate fraction and as a relatively inactive contact material for the hydrocarbon charge in the decarbonization zone.

Although the present invention is especially useful with hydrocarbon feedstocks containing substantial Ramsbottom carbon, it may also be used advantageously to crack other types of hydrocarbon feeds, such as gas oil, which may not contain substantial amounts of Ramsbottom carbon. As a general rule, atmospheric and vacuum bottoms will have a Ramsbottom carbon number of 1 or greater. Gas oil will usually have a Ramsbottom carbon number of less than 1 and boil between about 650° F. and about 1000° F. Gas oil usually will also contain a significant fraction of hydrocarbons which boil below about 650° F. By using the process of the present invention, the lower boiling fractions may be separated from the higher boiling fraction of the gas oil following treatment in the coked catalyst zone; and only the higher boiling fraction is cracked in the active catalyst zone. Atmospheric bottoms, also referred to as atmospheric resid, may also contain a significant fraction boiling below about 650° F. Although atmospheric resid, like vacuum resid, is high in Ramsbottom carbon and has an average boiling point greater than 1000° F., it usually will still contain lower boiling components, e.g., 5% or more by volume may have a boiling point of 650° F. or less, that it would be undesirable to feed to the active catalyst zone. In the present invention this fraction is vaporized in the decarbonization zone and separated from the higher boiling fractions. Thus, the lower boiling fraction is not fed to the active cracking zone.

DETAILED DESCRIPTION OF THE INVENTION

Figure 1:
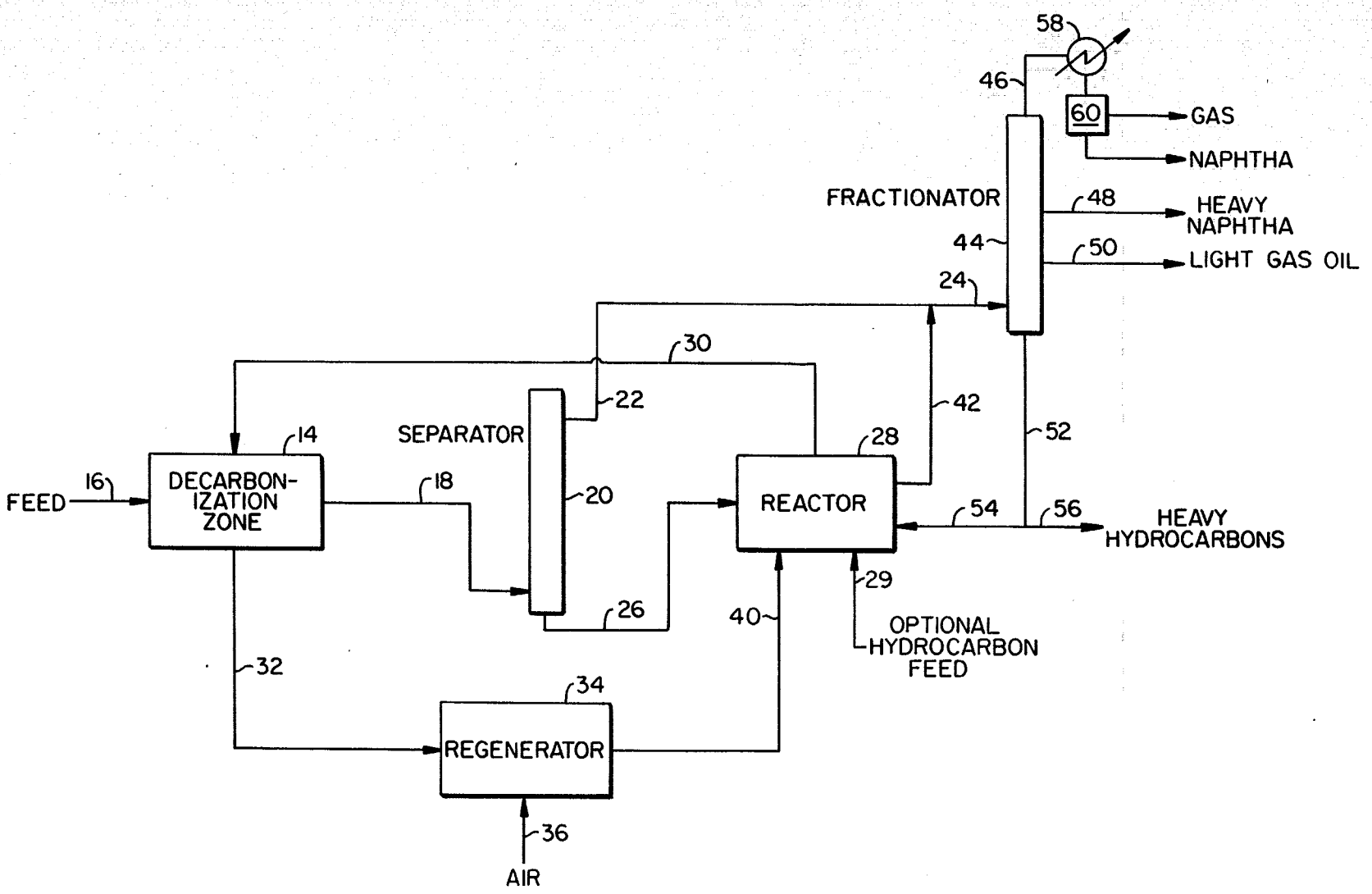
FIG. 1 is a schematic representation of one method for carrying out the process of the invention.

The invention will be more clearly understood by reference to FIG. 1 which illustrates one embodiment of the invention. A feed containing substantial metal and Ramsbottom carbon, such as atmospheric resid, is introduced by conduit 16 into a decarbonization zone 14. In the dcarbonization zone, the hydrocarbon is contacted with a particulate catalyst that has been sufficiently coked prior to introduction that its cracking activity is substantially lower than the fresh or regenerated catalyst. The contacting takes place at a temperature of at least 800° F. and more preferably at a temperature of between about 900° F. and 1100° F. Under these conditions, most or all of the Ramsbottom carbon will deposit as coke on the catalyst particles. The majority of the metals in the feed will also be deposited along with the coke on the particles. The decarbonization step is not intended as a cracking step, although some cracking of the hydrocarbons will typically occur in this step.

The hydrocarbons recovered from the decarbonization step, referred to herein as the hydrocarbon intermediate, will contain significantly less Ramsbottom carbon and metals than the original feed. This relatively clean hydrocarbon intermediate is sent by conduit 18 to separator 20. In the separator, a separation between components boiling, for example, above and below 650° F. is made. The lower boiling fraction, i.e., 650°− fraction, is recovered by conduits 22 and 24. The higher boiling fraction, i.e., 650°+ fraction, is carried by conduit 26 to the reactor section 28 which operates at conditions similar to those of a conventional fluidized catalytic cracking unit.

In the reactor 28, the high boiling fraction is cracked in the absence of added free hydrogen with an active catalytic cracking catalyst, most preferably a zeolitic cracking catalyst. In this cracking step, the high boiling fraction is converted to compounds of lower average molecular weight in the boiling range of gasoline and middle distillates. Also shown is an optional hydrocarbon feed entering via conduit 29. This optional feed may be a conventional hydrocarbon feedstock such as, for example, gas oil. Thus the high boiling fraction of the intermediate may comprise only part of the feed to the active catalyst zone. During cracking, coke is deposited on the particles of cracking catalyst leading to a reduction in its cracking activity. The cracking catalyst, after a significant reduction in its activity due to the deposited coke, is transferred by conduit 30 to the decarbonization zone where it will serve as the relatively inactive coked catalyst for the entering hydrocarbon. After further coke deposition, the catalyst is cycled by conduit 32 to a regeneration zone 34 where the coke is burned off. The regenerator 34 is a typical FCC regenerator in which the coke is burned in the presence of an oxygen containing gas such as air introduced via inlet 36. The regenerated catalyst is recycled to the reactor 28 via conduit 40 to crack additional heavy fraction entering by conduit 26.

The cracked hydrocarbons leave the reactor by conduit 42 and are mixed with the low boiling fraction recovered from the separator in line 24. This hydrocarbon mixture is carried to fractionator 44. In the fractionator 44, the hydrocarbons are separated into light overhead gases and light naphtha which are recovered by conduit 46, a heavy naphtha fraction recovered by 48, and a light gas oil fraction recovered by 50. A heavy hydrocarbon fraction is drawn off by outlet 52 which may be recycled to the reactor by conduit 54 and/or removed by conduit 56. The light overhead gases are passed through a cooler 58 and a separator 60 to recover the naphtha from the non-condensible gases.

As explained above, the decarbonization step is intended to remove the Ramsbottom carbon and metals from the feed to significantly upgrade the quality of the hydrocarbon sent to the cracker. In this step, the hydrocarbon feed is contacted with the relatively inactive coked cracking catalyst as compared to the active cracking catalyst employed in the cracking zone. Under the prevailing conditions of the coked catalyst zone, the Ramsbottom carbon will deposit on the relatively inactive catalyst as coke, removing most of the metals at the same time. The contacting is carried out on a low activity catalyst so that minimal cracking of the hydrocarbon occurs in this step. While the relatively inactive catalyst may retain significant cracking activity, the conditions in the decarbonization zone are preferably controlled to minimize cracking.

As will be explained below, in one embodiment of the invention the decarbonization step is carried out by introducing the feed directly into the stripping section of the FCC reactor. Thus, the decarbonization zone need not be a separate vessel from the reactor vessel as shown in the embodiment described in FIG. 1.

The separation of hydrocarbon products from the decarbonization zone may be carried out in a conventional fractionator. As illustrated in FIG. 1, the hydrocarbon intermediate is divided into only a high boiling fraction and a low boiling fraction. One skilled in the art will recognize that the hydrocarbon intermediate may be fractionated into more components should it be desirable to do so at this step. The purpose of this separation is to remove the low boiling components before sending the less valuable higher boiling components to the active catalyst zone. This separation not only makes the cracking step more efficient, but prevents overcracking of the more valuable lower boiling components in the reactor to less valuable light gases.

As described above, the separation of the hydrocarbon intermediate is between fractions boiling above and below 650° F. Depending upon the desired product slate, the cut point may be set higher or lower than this temperature. In the embodiment described in FIG. 1, it is assumed that a higher ratio of middle distillates is desired. Should it be desirable to increase the gasoline yield, a lower cut temperature, such as 450° F., would be chosen. Thus the cut temperature for the separation step may vary between about 400° F. and about 700° F., depending upon the desired end products.

The reactor is usually a conventional fluidized catalytic cracking reactor, except in the instance where the stripper is also used as the decarbonization zone. This embodiment will be discussed in greater detail below. The construction and operation of FCC reactors are well known and should not require any further explanation here.

The cracking catalyst may be a conventional cracking catalyst suitable for use in FCC units. Such catalysts are comprised of silica and alumina. It may be a conventional amorphous cracking catalyst containing an amorphous mixture of silica and alumina, or more preferably, a conventional zeolite containing cracking catalyst, including an amorphous silica-alumina matrix and a crystalline alumino-silicate zeolite. In the zeolitic catalyst, the amorphous matrix generally constitutes 75–95 weight percent of the cracking catalyst. The remaining 5–25 weight percent constitutes the zeolite component which is dispersed or imbedded in the matrix. The zeolite may be rare earth exchanged or hydrogen exchanged. Conventional zeolite containing cracking catalysts often include an X-type or a Y-type zeolite.

In the brief description of the invention, the cracking catalyst used in the cracking zone is referred to as a "regenerated cracking catalyst". This term is a relative term as compared to the less active coked catalyst employed in the decarbonization zone. One commonly used measure of activity is the microactivity as measured by ASTM method #3907. The regenerated cracking catalyst should have a minimum microactivity for catalytic cracking of 40. More preferably, the microactivity will be at least 60. The microactivity of the relatively inactive coked cracking catalyst, employed in the decarbonization zone, should be as low as practical. The microactivity will be dependent on the cracking catalyst employed and the amount of coke deposited on the particles. Ideally, the microactivity of the coked catalyst will preferably be less than 20. However, most generally the microactivity of the coked catalyst will be within the range of from about 30 to about 60, preferably below about 40.

Regeneration of the spent catalyst takes place in a catalyst regenerator such as a fluidized regeneration vessel in which air is used to fluidize the particles and supply molecular oxygen to burn off the coke. The temperature of such units usually falls within the range of about 1100° F. to 1350° F., with some units operating as high as 1400° F. or more. The regeneration temperature should not be so high that the catalyst is damaged. Since the catalyst when it also serves as contact solids in the decarbonization zone according to the present invention may contain more than conventional amounts of coke, care must be taken to prevent overheating. Following regeneration, the catalyst will still contain some coke, but usually this will be less than about 0.5% by weight of coke and preferably will fall in the range of 0.02% to 0.4% coke. Metal deposited on the catalyst may be removed or deactivated using methods known to the art. Some modern molecular sieves have a very high tolerance to metals contamination and may be used in the process for a substantial length of time before a significant reduction in activity is noted.

Figure 2:
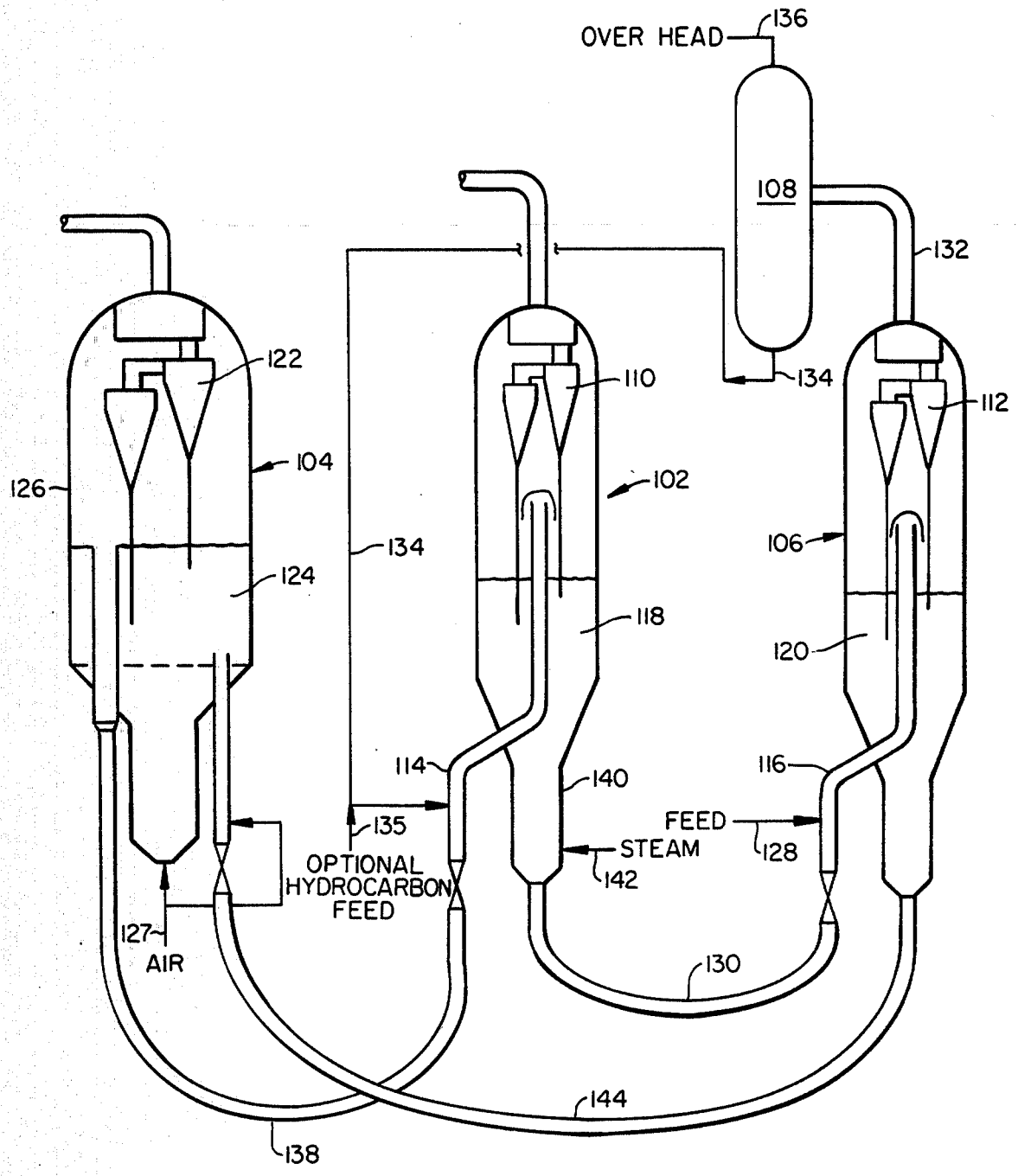
FIG. 2 illustrates one preferred embodiment of the invention wherein two reactors are employed in carrying out the invention.

In FIG. 2, one embodiment of the invention is represented. Shown is a fluidized catalytic cracking reactor 102, a catalyst regenerator 104, a decarbonization vessel 106, and a fractionator 108. The catalytic cracking reactor 102 and the decarbonization vessel 106 are similar in construction. Both vessels contain respectively, cyclones 110 and 112, a riser section 114 and 116, and a fluidized bed of catalyst particles 118 and 120. The regenerator contains cyclones 122 and a fluidized bed of catalyst particles 124 contained in the main combustion chamber 126. Air entering the regenerator via 127 provides oxygen to burn off the coke and fluidize the bed.

In operation, the feed, i.e., a hydrocarbon of high Ramsbottom carbon and metal content, is introduced by feed conduit 128 into the riser 116 leading into the decarbonization vessel 106. In the riser and decarbonization vessel the feed contacts relatively inactive cracking catalyst carried by conduit 130 from the cracking vessel 102. Volatile components of the feed are vaporized in the decarbonization zone and pass out the top of the vessel via conduit 132 to the fractionator 108. Nonvolatile components and metals in the feed deposit as coke onto the spent catalyst. The heavy hydrocarbons collected by the fractionator are sent by conduit 134 to the riser 114 of the craking reactor 102. Hydrocarbon feedstocks that will not benefit substantially from treatment in the inactive zone may be fed directly to reactor 102 via conduit 135. Lighter products are collected as the overhead from the fractionator by conduit 136.

In the riser 114 the heavy hydrocarbons contact regenerated cracking catalyst returning from the regenerator 104 via conduit 138. The heavy hydrocarbons are cracked, and coke is deposited on the catalyst particles to significantly lower the cracking activity of the catalyst. Any volatile hydrocarbons remaining on the catalyst particles are removed in the stripper 140 by steam entering via 142. The coked catalyst passes to the decarbonization zone via conduit 130 where additional coke will be deposited on the particles. From the decarbonization vessel the coked catalyst is returned to the regenerator via conduit 144.

Figure 3:
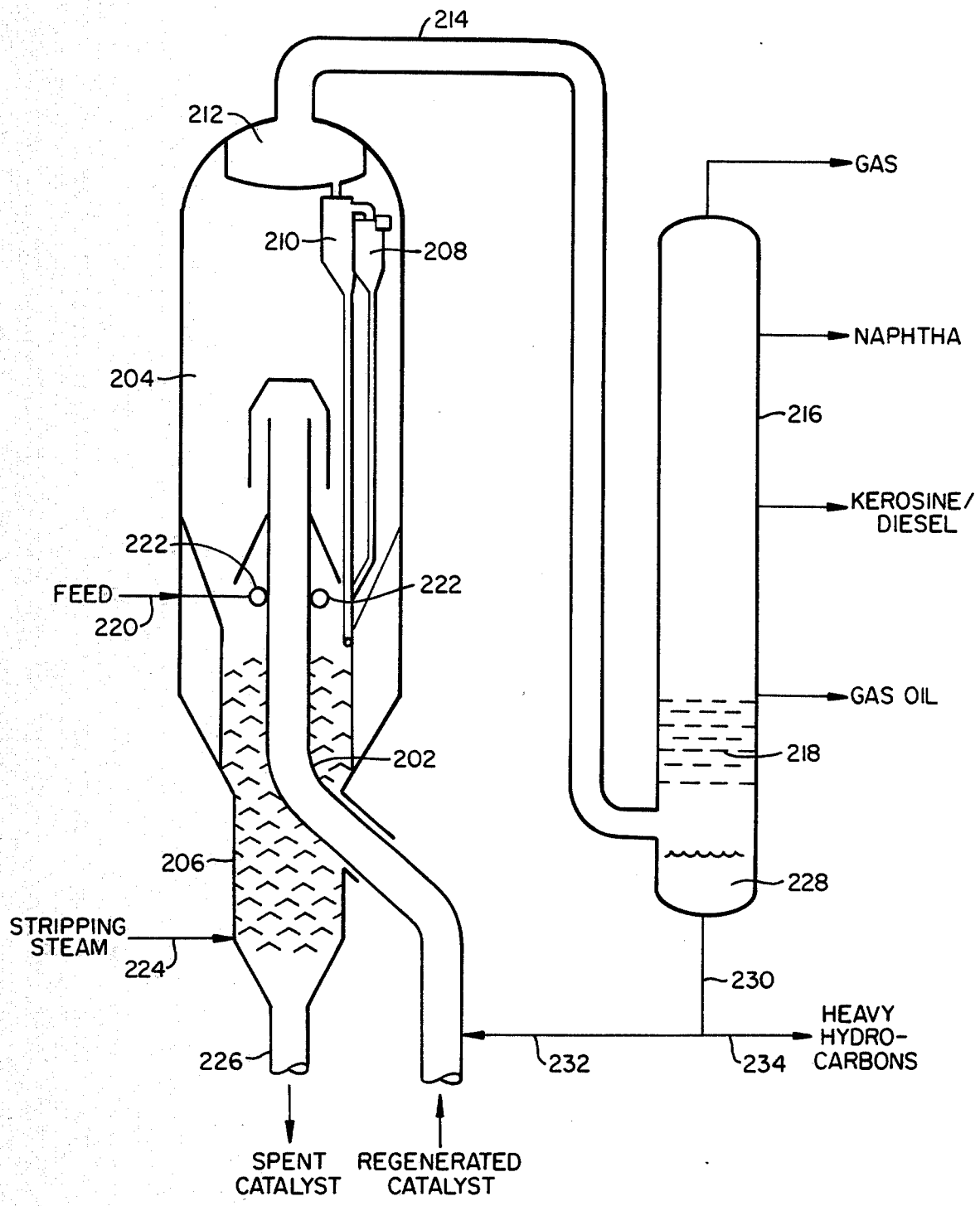
FIG. 3 illustrates an FCC reactor design and fractionator which may be used to practice one embodiment of the invention.

In FIG. 3, another embodiment of the invention is shown. Illustrated is a fluidized catalytic cracking reactor having a riser section 202, a dilute phase area 204, and a stripping section 206. The dilute phase area 204 contains two-stage cyclones 208 and 210, respectively, for recovering catalyst particles and returning them to the reactor. The second-stage cyclone opens into a plenum chamber 212 at the top of the reactor vessel. A product recovery conduit 214 leads away from the reactor to a fractionator 216 containing a tray section 218.

In the reactor, shown in FIG. 3, regenerated catalyst from the catalyst regenerator (not shown) enters the bottom of riser 202, and is discharged from the riser into dilute phase area 204. In operation, the feed is introduced by conduit 220 into the top of the stripping section 206 by a ring distributor 222. In the stripping section, the feed contacts hot coked catalyst particles leaving the dilute phase area 204. Volatile components of the feed are vaporized in the stripper, which usually has a temperature between about 900° F. and 1000° F. The vapors pass upward out of the stripper into the dilute phase area 204 where they become mixed with cracked hydrocarbon vapors from the riser. The hydrocarbon mixture passes out of the reactor via the cyclones 208 and 210 and the plenum chamber 212. Nonvolatile components of the feed deposit as coke onto the spent catalyst in the stripper. Stripping steam entering the bottom of the stripping section via line 224 removes any volatiles in the coke before the coked catalyst is withdrawn from the bottom of stripper section 206 by draw pipe 226. The spent catalyst is sent to a regenerator (not shown) where the coke is burned off the catalyst particles.

The mixture of cracked hydrocarbons and volatiles recovered from the stripping section passes to the fractionator 216 where the heavy hydrocarbon product 228, e.g., that fraction boiling above about 650° F., is separated from non-condensible gas and lower-boiling products. The heavy hydrocarbons 228 are drawn off by line 230 and passed to the riser section 202 of the reactor by line 232. Excess heavy hydrocarbon may be removed via 234.

In the riser section 202, the heavy hydrocarbons are mixed with hot regenerated catalyst so that the riser outlet temperature is usually in the range of from about 900° F. to about 1100° F. Under the conditions prevailing in the riser, the heavy hydrocarbons are cracked into products having a lower average molecular weight. During cracking, coke is deposited on the catalyst particles, thereby significantly lowering their cracking activity. The spent catalyst is separated from the cracked hydrocarbon products in the main reactor section 204. The spent catalyst passes into the stripper 206 where it serves as relatively inactive contact material. The cracked hydrocarbons are mixed with volatile hydrocarbons from the stripper and pass out of the reactor to the fractionator.

The embodiment shown in FIG. 3 contains several unique features that make possible greater selectivity to liquid products.

By introducing the fresh feed into the top of the stripper, any desirable low boiling components will pass through the system unconverted, i.e., uncracked. Overcracking of lighter materials will be minimized.

Nonvolatile high boiling range hydrocarbons, i.e., 1000°+ F. hydrocarbons, will be deposited on the spent catalyst in the stripper, rather than in the riser section; and, if the residence time and temperature are sufficient, the high boiling components will coke and the volatiles will be collected with the products in the fractionator. It is preferable to have this coking of nonvolatile hydrocarbons proceed in the stripper, rather than in the riser section as would occur during conventional reactor operation, so that the catalyst will be cleaner and more reactive when cracking the heavy hydrocarbon intermediates. The process outlined above would also be suitable for cracking a feed having an upper boiling point not exceeding about 1100° F. Thus, the process could also be used to crack heavy gas oils.

A particularly advantageous design for carrying out the process as shown in FIG. 3 is to separate the catalyst and products using a means similar to the vented riser described in U.S. Pat. No. 4,341,624. In this system the catalyst particles are separated ballistically from the vaporized hydrocarbon stream. The advantage of this design is that the cracked vapors can be collected separately from the vaporized hydrocarbon products produced by the decarbonization of the residua in the stripper. In this embodiment only the vaporized hydrocarbons produced in the decarbonization zone would be passed through the separator. Thus recycling of the vapor products of the cracking step back to the reactor would be avoided. This modification allows better control over yields and product qualities than does the embodiment of FIG. 3.

Figure 4:
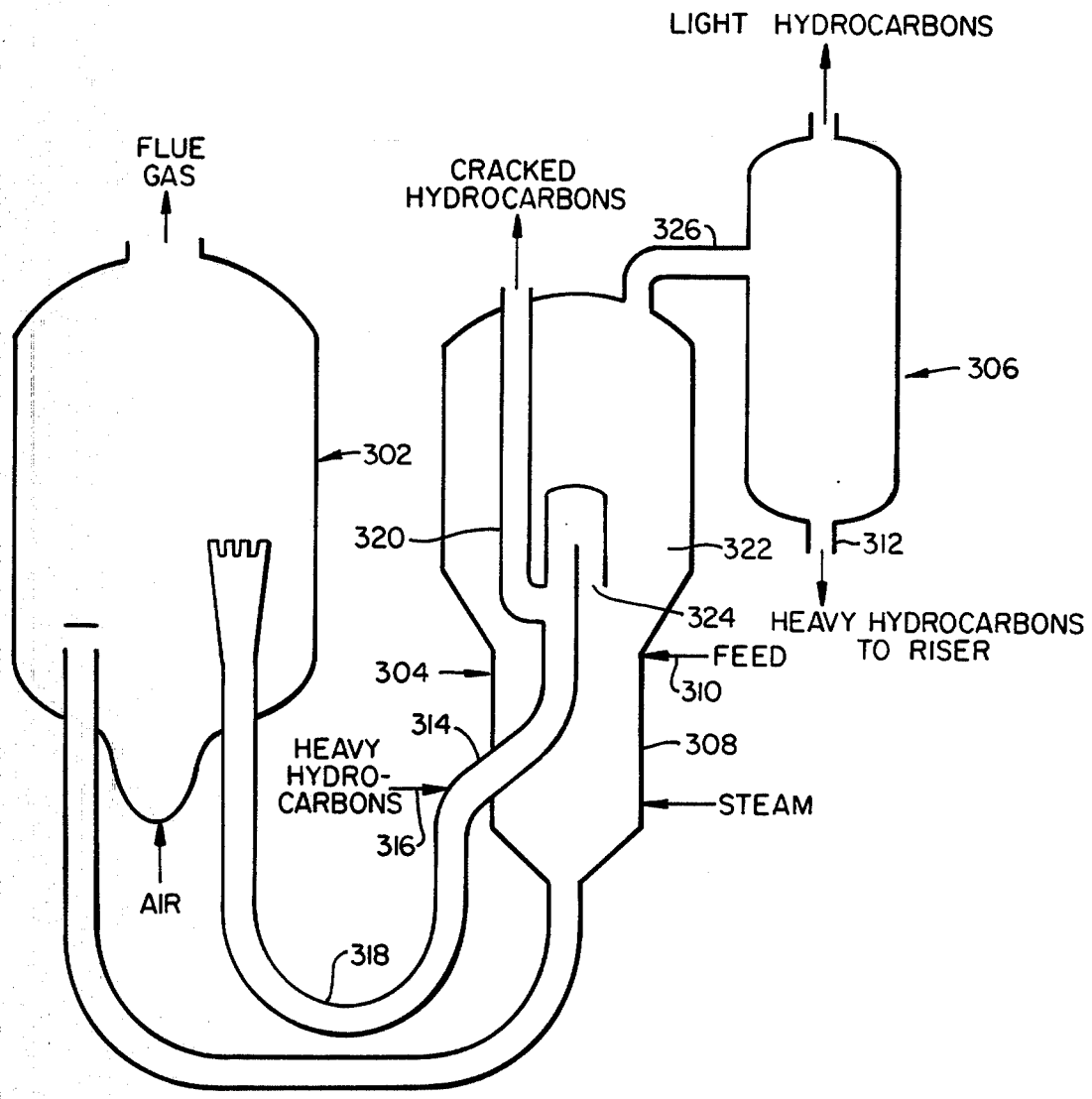
FIG. 4 shows a process similar to that in FIG. 3 except that means are provided to keep the hydrocarbon products from the stripper and the riser separate.

This embodiment is shown in FIG. 4. Illustrated is a regenerator 302, a cracking vessel 304, and a separator 306. The general operation of the unit is similar to that described in FIG. 3. The hydrocarbon feed is introduced into the top of the stripping section 308 of the cracking vessel 304 via feed inlet 310. Heavy hydrocarbons recovered by the separator 306 are carried by outlet 312 and recycled to the riser 314 of the cracking vessel for introduction at inlet 316. The regenerated catalyst carried from the regenerator via conduit 318 contacts the recycled heavy hydrocarbons in the riser as already explained in connection with FIG. 3. However, at the top of the riser the cracked hydrocarbons are carried off by vent pipe 320. The coked catalyst enters the main chamber 322 of the cracking vessel via outlet 324. Thus, outlet pipe 326 carries only hydrocarbon vapors resulting from the decarbonization step that takes place in the stripper 308.

It may be desirable in some instances to provide a means for controlling the temperature of the coked catalyst zone independently of the active catalyst zone. In general, it would be desirable to add heat to the coked catalyst zone. Means for accomplishing this end could include heat exchange between regenerated catalyst and catalyst entering the coked catalyst zone. Heat may also be supplied directly to the coked catalyst zone by placing the zone within the relatively hot regenerator itself. Other means for providing heat to the coked catalyst zone will be apparent to those skilled in the art, having regard to this disclosure.

What is claimed is:

1. A process for catalytically cracking a hydrocarbon charge which comprises:

(a) contacting the hydrocarbon charge in a coked catalyst zone at a temperature of at least 800° F. with a coked cracking catalyst having significantly reduced cracking activity, whereby at least a portion of the hydrocarbon charge is vaporized;

(b) separating the hydrocarbon vapors into at least a high boiling fraction and a low boiling fraction;

(c) reducing the amount of coke on the coked catalyst of step (a) in a regeneration zone by contacting the coked catalyst with molecular oxygen for a sufficient residence time and at a suitable temperature to regenerate the cracking catalyst;

(d) cracking the high boiling fraction from step (b) in the absence of added free hydrogen in a cracking zone by contacting said high boiling fraction with the regenerated cracking catalyst, whereby a hydrocarbon product having a lower average molecular weight than the high boiling fraction is produced and coke is deposited on the cracking catalyst to significantly lower its cracking activity; and (e) introducing the coked cracking catalyst of step (d) into the coked catalyst zone for the purpose of contacting additional hydrocarbon charge.

2. The process of claim 1 wherein the coked catalyst in the coked catalyst zone has a microactivity for catalytic cracking of less than 60.

3. The process of claim 2 wherein the coked catalyst in the coked catalyst zone has a microactivity for catalytic cracking of less than 40.

4. The process of claim 1 wherein the contacting between the hydrocarbon charge and the coked cracking catalyst takes place at a temperature of between about 900° F. and 1000° F.

5. The process of claim 1 wherein the high boiling fraction of step (b) comprises only a part of the feed entering the cracking zone in step (d).

6. The process of claim 1 wherein separation between the high boiling and low boiling fractions of the hydrocarbon vapors is made at a temperature of between about 400° F. and about 700° F.

7. The process of claim 1 wherein the amount of coke on the cracking catalyst is reduced to no more than about 0.5% by weight during regeneration.

8. The process of claim 1 wherein the coked catalyst zone is the stripping section of a fluid catalytic cracking reactor and the high boiling fraction of the hydrocarbon vapors is recycled to the riser of a fluid catalytic cracking reactor.

9. The process of claim 8 wherein the stripping section and the riser are incorporated in the same fluid catalytic cracking reactor.

10. The process of claims 8 or 9 wherein the high boiling fraction of the hydrocarbon vapors comprises only part of the hydrocarbons entering the riser.

11. The process of claim 8 wherein the hydrocarbon product produced by cracking the high boiling fraction is ballistically separated from the coked cracking catalyst and removed from the fluid catalytic cracking reactor separately from the hydrocarbon vapors formed in the stripping section.

12. The process of claim 1 wherein the hydrocarbon charge contains high boiling components and is characterized by a substantial Ramsbottom carbon number.

13. The process of claim 12 wherein the hydrocarbon charge has a Ramsbottom carbon number of at least 1.

14. The process of claim 1 wherein the hydrocarbon charge contains a significant fraction boiling below 650° F.

15. The process of claim 1 wherein the hydrocarbon charge has a broad boiling range and is characterized by both a substantial Ramsbottom carbon number and at least a significant fraction boiling below 650° F.

16. The process of claim 15 wherein the fraction boiling below 650° F. makes up more than 5% by volume of the hydrocarbon charge.

17. The process of claim 1 wherein the hydrocarbon charge boils between about 650° F. and 1100° F., said hydrocarbon charge further having a Ramsbottom carbon number of less than 1.

18. The process of claim 1 wherein additional heat is provided to the coked catalyst zone.

19. A process for catalytically cracking a hydrocarbon charge containing high boiling components and substantial Ramsbottom carbon number which comprises:

(a) contacting the hydrocarbon charge in a decarbonization zone at a temperature of at least 800° F. with a coked cracking catalayst having significantly reduced cracking activity, whereby a hydrocarbon intermediate containing reduced Ramsbottom carbon as compared to the hydrocarbon charge is produced and additional coke is deposited on said coke catalyst;

(b) separating the hydrocarbon intermediate into at least a high boiling fraction and a low boiling fraction;

(c) reducing the amount of coke on the coked catalyst of step (a) in a regeneration zone by contacting the coked catalyst with molecular oxygen for a sufficient residence time and at a suitable temperature to regenerate the cracking catalyst;

(d) cracking the intermediate high boiling fraction in the absence of added free hydrogen in a cracking zone by contacting the hydrocarbon intermediate with the regenerated cracking catalyst, whereby a hydrocarbon product having a lower average molecular weight than the high boiling fraction is produced and coke is deposited on the cracking catalyst to significantly lower its cracking activity;

(e) recovering the hydrocarbon product of step (d) separately from the hydrocarbon intermediate of step (a); and (f) introducing the coked cracking catalyst of step (d) into the decarbonization zone for the purpose of contacting additional hydrocarbon charge.

20. The process of claim 19 wherein step (a) is carried out in a separate reactor vessel from step (d).

21. The process of claim 19 wherein the high boiling fraction of the hydrocarbon intermediate comprises only part of the hydrocarbons entering the cracking zone in step (d).

22. The process of claim 19 wherein step (a) is carried out in the stripping section of a fluid catalytic cracking reactor and step (d) is carried out by recycling the high boiling fraction to the riser of said fluid catalytic cracking reactor, the hydrocarbon intermediate from the stripper and the hydrocarbon product from the riser being recovered separately from the fluid catalytic cracking reactor by the additional steps of ballistically separating the cracking catalyst from the hydrocarbon product and withdrawing the hydrocarbon product by recovery means opening directly into the riser and separate from the means used to withdraw the hydrocarbon intermediate from the stripping section.

23. A process for catalytically cracking a hydrocarbon charge boiling below about 1100° F. with a Ramsbottom carbon number of less than 1, the process comprising:

(a) contacting the hydrocarbon charge in an coked catalyst zone at a temperature of at least 800° F. with a coked cracking catalyst having significantly reduced cracking activity , whereby hydrocarbon vapors are produced;

(b) separating the hydrocarbon vapors into at least a high boiling fraction and a lower boiling fraction;

(c) reducing the amount of coke on the coked catalyst of step (a) in a regeneration zone by contacting the coked catalyst with molecular oxygen for a sufficient residence time and at a suitable temperature to regenerate the cracking catalyst;

(d) cracking the high boiling fraction from step (b) in the absence of added free hydrogen in a cracking zone by contacting the high boiling fraction with the regenerated cracking catalyst, whereby a hydrocarbon product having a lower average molecular weight than the high boiling fraction is produced and coke is deposited on the cracking catalyst to significantly lower its cracking activity;

(e) recovering the hydrocarbon product of step (d) separately from the hydrocarbon vapors of step (a); and (f) introducing the coked cracking catalyst of step (d) into the coked catalyst zone for the purpose of contacting additional hydrocarbon charge.

24. The process of claim 23 wherein step (a) is carried out in a separate reactor vessel from step (d).

25. The process of claim 23 wherein step (a) is carried out in the stripping section of a fluid catalytic cracking reactor and step (d) is carried out by recycling the high boiling fraction to the riser of said fluid catalytic cracking reactor, the hydrocarbon intermediate from the stripper and the hydrocarbon product from the riser being recovered separately from the fluid catalytic cracking reactor by the additional steps of ballistically separating the cracking catalyst from the hydrocarbon product and withdrawing the hydrocarbon product by recovery means opening directly into the riser which is separate from the means used to withdraw the hydrocarbon vapors from the stripping section.

* * * * *